US008627532B2

(12) United States Patent
Hui

(10) Patent No.: US 8,627,532 B2
(45) Date of Patent: Jan. 14, 2014

(54) POOL CLEANING VEHICLE HAVING IMPROVED INTAKE PORT

(75) Inventor: Wing-kin Hui, Hong Kong (HK)

(73) Assignee: Smartpool LLC, Lakewood, NJ (US)

( * ) Notice: Subject to any disclaimer, the term of this patent is extended or adjusted under 35 U.S.C. 154(b) by 1393 days.

(21) Appl. No.: 12/100,414

(22) Filed: Apr. 10, 2008

(65) Prior Publication Data

US 2009/0255070 A1 Oct. 15, 2009

(30) Foreign Application Priority Data

Apr. 10, 2007 (CN) ..... 2007 1 0095854

(51) Int. Cl.
*E04H 4/16* (2006.01)

(52) U.S. Cl.
USPC ..... 15/1.7

(58) Field of Classification Search
USPC ..... 15/1.7; 210/167.1, 167.15–167.17; 134/111
IPC ..... E04H 4/16
See application file for complete search history.

(56) References Cited

U.S. PATENT DOCUMENTS 3,102,289 A * 9/1963 Norris ..... 15/1.7
4,100,641 A * 7/1978 Pansini ..... 15/1.7
4,849,024 A * 7/1989 Supra ..... 134/21
5,197,158 A * 3/1993 Moini ..... 15/1.7
5,412,826 A * 5/1995 Raubenheimer ..... 15/1.7
6,409,916 B1 * 6/2002 Zelas et al. ..... 210/167.16
6,792,956 B2 * 9/2004 Bredo et al. ..... 134/22.18
6,942,790 B1 * 9/2005 Dolton ..... 210/167.16
2002/0104790 A1 * 8/2002 Lincke ..... 210/169
2005/0247613 A1 * 11/2005 Bishop et al. ..... 210/169

FOREIGN PATENT DOCUMENTS

FR 2685374 A1 * 6/1993

* cited by examiner

*Primary Examiner* — Lee D Wilson
*Assistant Examiner* — Tyrone V Hall, Jr.
(74) *Attorney, Agent, or Firm* — Birch, Stewart, Kolasch & Birch, LLP

(57) ABSTRACT

A swimming pool cleaning device is disclosed herein. The device includes a vehicle having a body shell and an interior and at least one intake port located on the body shell. The vehicle includes at least one water outlet port also located on the outer shell. The vehicle includes a drive mechanism which in different embodiments includes pairs of wheels and/or rollers or a combination of wheels and rollers In one embodiment the wheels or rollers can be power driven, while in another embodiment they would be free rotating, and can easily climb over obstacles on a swimming pool floor. In one embodiment, the intake ports are located in close proximity to the drive mechanism. In another embodiment, the vehicle has a concaved bottom. The concaved bottom points towards the interior. In this embodiment the intakes can be located slightly farther away from ends of the vehicle as a result of the curvature of the bottom.

15 Claims, 4 Drawing Sheets

POOL CLEANING VEHICLE HAVING IMPROVED INTAKE PORT

FIELD OF THE INVENTION

This invention relates to the field of pool cleaning devices and more particularly to domestic or industrial swimming pool cleaners.

TECHNICAL BACKGROUND

The swimming pool cleaners currently used for cleaning swimming pools can be divided into the following groups: the wheel type, the roller type, the track type or the hydraulic propulsion type. In general, the cleaning device includes the following parts as illustrated in FIG. 1: a body shell (100) which forms an empty interior volume; at least one water intake port (130) located on the body shell (100), a pivoted door (160) on top of the water intake port (130); at least one filter bag (120) located inside the body shell (100) having a predetermined volume, which filters water from the water intake port (130); at least one water outlet port (140), located on the body shell (100); and at least one water pump (110) located under the water outlet port (140) used to discharge water outside the outer shell.

A partial vacuum is formed inside the body shell, dirt and debris stirred up by the vehicle enters the cleaner through the water intake port (130), into the filter bag (120), which is typically mounted at the perimeter of the water intake port (130). Dirt and debris is filtered and clean water is returned to the pool through outlet port (140), the known cleaner has a drive assembly including a wheel assembly and/or a roller (170) driven by a motor inside or outside the body shell (100). Alternatively the cleaner is jet propelled by a water pump inside or outside the body shell (100). The pump drives the swimming pool cleaner along the swimming pool floor.

Location of water intake port is a crucial to the cleaner's ability to clean. Typically, the intake port is located at the bottom of the body shell. The clearance between the water intake port and swimming pool floor affects the capability to pick up dirt and debris during cleaning cycle. The water intake port cannot be too high above swimming pool floor or the dirt and debris settled on swimming pool floor will not be picked up by the limited partial vacuum and limited water flow by the water pump.

The swimming pool cleaner can become hung up and not running normally as it moves along the pool surface. Obstacles such as swimming pool main drain present an uneven swimming pool floor surface. If the intake is too low, then it will clearly get hung up on such obstacles.

When such incidences occur, the motor powering the cleaner needs to work hard. The motor is subject to excessive wear and even failure or burn because it runs hard at idle attempting to overcome the obstacle and preventing normal swimming of the cleaner during its cleaning operation. Additionally, the cleaner risks crashing causing premature wear and even failure and promoting a causing higher than necessary defective rate and increased maintenance costs.

As disclosed in U.S. Pat. No. 5,930,856 water intake ports are located between the swimming pool cleaner's front and back wheels. A roller embodiment includes a roller located at the middle of a generally flat bottom cleaner with the water intake port in close proximity thereto. However, this design does not ensure that the distance between water intake port and the swimming pool floor will remain unchanged as the swimming pool cleaner runs along the surface of a pool having different pool floor topology. In this cleaner, the distance between water intake port and the swimming pool floor could be too high or too low, when the swimming pool cleaner passes steps or valleys in the pool surface. The ability of the cleaner will be reduced and may prevent dirt and debris from being picked up.

China patent CN03107459.6 discloses a swimming pool cleaner which can overcome the above mentioned problem, as shown in FIG. 2. That disclosure comprises a body shell (100), water pump (110), filter bag (120), water intake port (130), water outlet port (140), skirt (150) and a pivoted door (160) and front and rear wheel (170). The design of the skirt (150) effectively lowers the water intake port. When the skirt (150) is made of flexible material, it flexes as it reaches particulates on the swimming pool floor, and stirs up dirt and debris settled on the swimming pool floor. The skirt does not affect the ability of the cleaner to move along the pool surface. However, if the skirt (150) drops too low, particulates will merely be push around and not picked up and sucked into the cleaner through the water intake port (130).

It is possible for the skirt to become stuck by uneven swimming pool floor. Additionally, the skirt cannot be sealed otherwise dirt and debris or segregates in the water would not be sucked into the cleaner. If the skirt is not sealed, water does not coverage and therefore it does not generate enough partial vacuum and water flow to bring up the dirt and debris and/or segregates through the intakes.

Improvements are needed as existing swimming pool cleaners have short comings and limitations as explained above.

SUMMARY OF THE INVENTION

It is an object of the pool cleaning device in accordance with this invention to provide a cleaning vehicle having an intake member and the intake member maintaining, generally an unchanged distance between the intake port and the pool floor.

To achieve the objects of the invention described above and those that will be understood hereinafter, the swimming pool cleaning device in accordance with this invention, comprises:

a vehicle having a body shell with a hollow interior;

the vehicle having at least one inlet port located on the body;

the vehicle having at least one outlet port located on the body;

the vehicle including a drive mechanism; and the intake port being in close proximity to the drive mechanism.

According to swimming pool cleaner of this invention, the intake port has an opening and the opening opens toward the drive mechanism.

According to swimming pool cleaner of this invention, the vehicle includes a plurality of intake ports, each of the intake ports is connected to a filter bag. In one embodiment, there is a single filter bag and multiple intake ports. All intake ports are connected to that single filter bag so that the inlet ports all share the same filter bag.

According to the swimming pool cleaner of this invention, the intake port is located in close proximity to the pool floor.

According to the swimming pool cleaner of this invention, the intake port is located on the shell bottom.

According to the swimming pool cleaner of this invention, the drive mechanism includes two pairs of wheel; one located toward the front of the vehicle, the other pair located toward the rear. The vehicle having water intake ports located in close proximity to the front and rear ends.

According to swimming pool cleaner described in this invention, the body shell bottom is concave inwards.

According to the swimming pool cleaner of this invention, the vehicle includes a guard rail and the water intake port is located on the guard rail proximate to the drive mechanism.

In another embodiment, in accordance with the pool cleaner of this invention, the water intake port forms part of the guard wall.

In another embodiment of the pool cleaner in accordance with this invention, the water intake ports are located on the outside of the vehicle, and away from the bottom of the vehicle.

This invention provides a swimming pool cleaner including intake ports located on the body shell in close proximity to the drive mechanism. In each of the embodiments in accordance with the invention, the drive mechanism defines the contact points between the pool cleaner and the pool floor. Since the intakes are located near the drive mechanism, the floor clearance remains basically unchanged during movement of the vehicle.

The vehicle easily climbs over pool floor obstacles regardless of whether the drive mechanism comprises wheels or rollers or a combination thereof. In an exemplary embodiment, the vehicle has a suspension similar to that of a car. Consequently, the vehicle of this embodiment has lower floor clearance without affecting a vehicle movement and as long as the intakes are is placed close to the wheels a generally constant distant between the intake and the floor is maintained. Since the intakes maintain a constant clearance with the pool surface, less clearance is needed as the vehicle travels around the pool surface. The closer to the pool contact points, the less the necessary clearance.

It is an advantage of the cleaning device in accordance with this invention to provide a vehicle for cleaning pools which allows intakes to be place closer to the pool surface than previously possible.

It is also an advantage to provide such a cleaning device which provides improved ability to pick up dirt and debris as well as segregrates despite pool floor topology. a

DETAILED DESCRIPTION OF THE INVENTION

Figure 1:
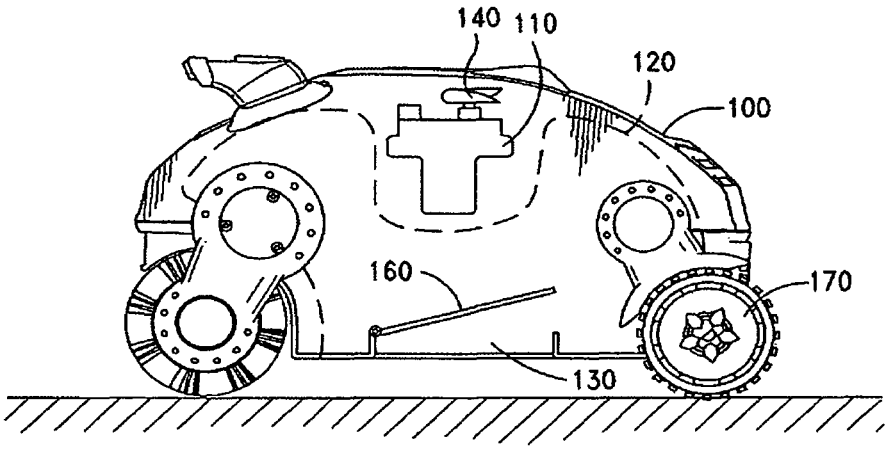
FIG.—1 (Prior Art)
FIG. 1 shows an existing swimming pool cleaner as described in the Background above.
Figure 2:
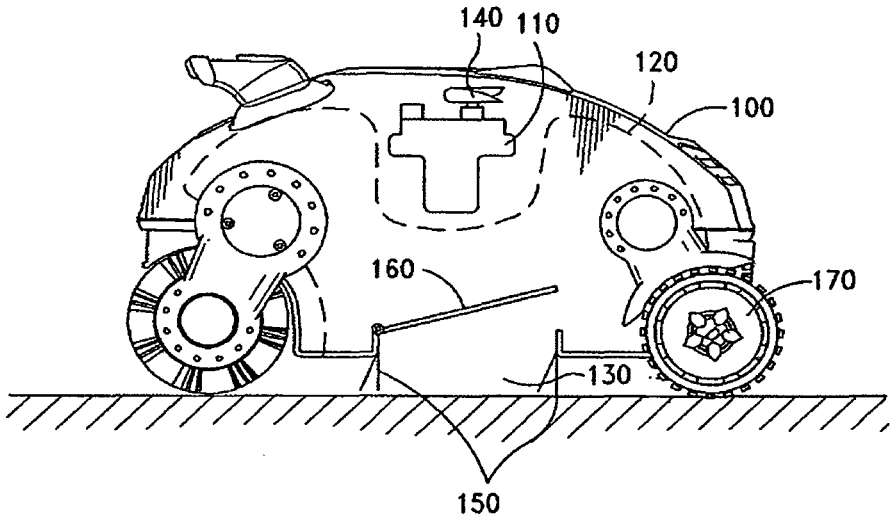
FIG.—2 (Prior Art)
FIG. 2. shows another existing swimming pool cleaner also as described in the Background above.

To better illustrate the objects and advantages of the roller brush assembly in accordance this invention, a detailed description of the drawing is provided below. As will be appreciated by those skilled in the art, the exemplary embodiments are provided for explanation only and are not to be for purposes of limiting the scope of the invention.

Figure 3:
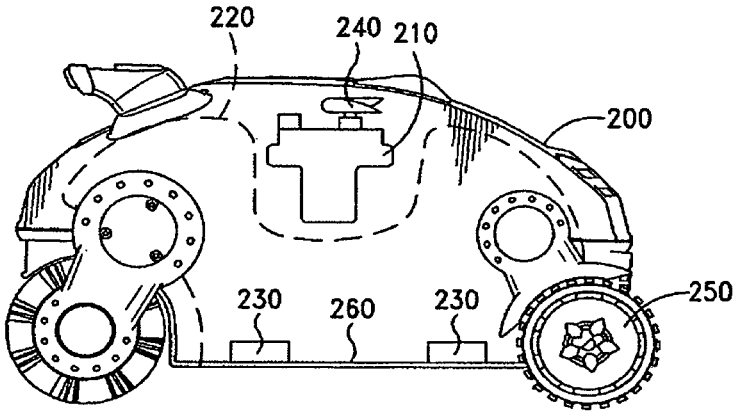
FIG. 3. illustrates an exemplary embodiment of the pool cleaning device in accordance with this invention.

FIG. 3 illustrates a swimming pool cleaner in accordance with this invention which, comprises a vehicle including a body shell (200). The shell forms an interior volume and defines a container. Within the interior volume are included one or more water pumps (210). The number of water pumps (210) corresponds to the outlet ports (240).

The vehicle also includes a drive mechanism. The drive mechanism includes pairs of wheels or rollers or a combination of wheels and rollers (250) depending on the embodiment herein. In this disclosure the numeral 250 is assigned to both wheels and/or rollers. The vehicle has a horizontal bottom (260) of the body shell (200). The drive mechanism is located generally at the bottom 260.

In this embodiment there are multiple intake ports (230). In this embodiment, the intake ports (230) are located on the bottom (260) and in close proximity to one of the wheels and/or rollers (250). The intake port (230) has an opening facing toward the swimming pool floor when the vehicle is upright. However, in another embodiment, it would be within the spirit and scope of the invention for the intake ports (230) having an opening facing toward the wheels and/or rollers (250).

Figure 4:
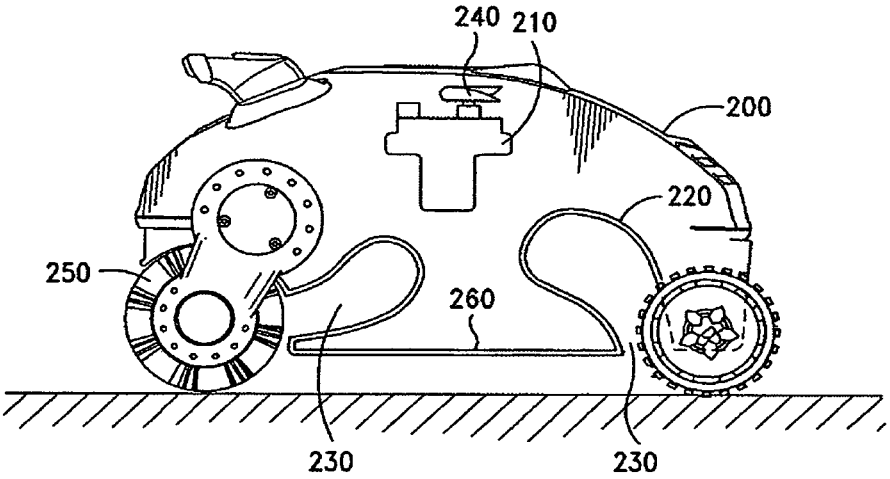
FIG. 4. illustrates another exemplary embodiment of the pool cleaning device in accordance with this invention.

It will of course be appreciated that an embodiment contemplated having only a single intake port. In this embodiment, there are multiple intake ports. Each of the intake ports (230) feeds into a single filter bag (220). As illustrated, the filter bag (220) is located in the interior of the body shell (200). In other embodiments within the spirit and scope of the invention, the filter bag (220) is located outside the body shell (200) and it is also possible for the vehicle to include a filter bag for each intake port (230) as illustrated in FIG. 4.

The water pump (210) is used to discharge water outside the body shell (200). This creates a partial vacuum inside the body shell (200) as well as stirring up water. When the water is stirred up dirt and debris settled on the pool floor rises up. This enables the stirred up dirt and debris to be easily picked up by the water intake ports (230). The picked up dirt and debris is then filtered through the filter bag (220) and trapped therein. The filter bag is mounted on the perimeter of intake ports (230) as shown.

The closer the water intake ports (230) are to the pool floor, the higher will be the water flow rate. Clearly the higher the water flow rate the more effective the cleaner is in sucking up dirt and debris. Since the body shell (200) bottom (260) is close to swimming pool floor, placing the water intake port (230) at body shell (200) bottom (260) helps to improve cleaning power.

Typically the drive mechanism has wheels (250). In one embodiment, the wheels (250) are similar to a tricycle. However, in another embodiment there are two pairs of wheels placed on both ends of vehicle bottom. It is obvious to the person of ordinary skill in the art that the vehicle in accordance with this invention includes 3 or more pairs of wheels (250) in another embodiment.

In the embodiment where the cleaner includes only rollers, there are two such rollers (250). In this embodiment, a roller is located at either end of the vehicle. In another embodiment, there are three rollers (250).

In another embodiment, a combination of wheels and rollers (250) are used, In one combination embodiment, there are a pair of wheels and one roller. The wheel pair and roller are located at both ends of the vehicle bottom. Clearly, the vehicle may have additional wheels and/or rollers within the spirit and scope of the invention.

The wheels and/or rollers (250) are driven by motor placed inside or outside the vehicle interior. In another embodiment, the wheels and/or rollers (250) are driven by a water jet. The water pump generates pressurized water and forms a jet stream of water for propulsion. The water pump is located either inside or outside the vehicle. (Not shown in the illustration).

The roller (250) is not limited to cylindrical object across the vehicle. A wheel having circumference in the shape of brush or any device, which stirs up water, for the purposes of this description is also considered a roller (250). It will also be appreciated that the wheels have unlimited width. The wheels can be as wide as the vehicle itself width.

In the cleaner in accordance with this invention, the intake ports (230) are located at or near each wheel or roller (250). In another embodiment, the intake ports (230) are located at or near a certain number of wheels or rollers (250). In another embodiment, there is at least one water intake port (230) on the vehicle bottom (260) and it is located at or near a wheel or roller (250).

Since the wheels and/or rollers (250) of vehicle are the contact points between the cleaner and the pool floor, no matter whether the wheels and/or rollers are power driven, or free rotating, the vehicle will easy climb over obstacles on swimming pool floor. When the vehicle is moving around on different types of pool floor topology, for example steps or valleys, the location of the intake ports close to the swimming pool floor makes it easier for the vehicle in accordance with the invention to pick up dirt and debris and therefore increase the capability of the vehicle clean the pool water.

FIG. 4 illustrates another embodiment of the swimming pool cleaning device in accordance with this invention. In this embodiment, the water intake ports (230) are located near front and rear ends of the vehicle.

The intake ports (230) of this embodiment is neither horizontal nor vertical. Since the wheels and/or rollers (250) are normally located near either end of the vehicle bottom (260), the intake ports are consequently located near both ends. The intake ports (260) have more room and therefore bigger water passageway when the water intake ports are neither horizontal nor vertical, for example, when the intake opening faces the front at an angle. This allows bigger particles of debris such as tree nuts to be sucked in through the intake ports. The intake ports are not limited by the narrow space at the lower part of vehicle bottom (260). Each water intake port (230) includes its own filter bag (220) and the filter bag (220) is placed inside the Vehicle. As described above the filter bag (220) can also be placed outside the body shell (200).

Figure 5:
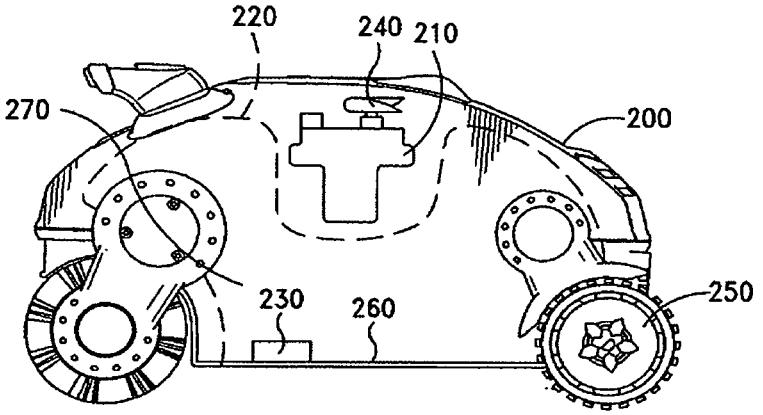
FIG. 5 illustrates another exemplary embodiment of the pool cleaning device in accordance with this invention.

FIG. 5 illustrates another embodiment of the swimming pool cleaning device in accordance with this invention. In this embodiment, the intake ports (230) are placed on the outside wall (270) of the vehicle body shell (200) and close to driver mechanism. The water intake ports (230) have an opening facing the swimming pool floor or facing the wheel and/or roller (250). Since water intake port (230) is close to swimming pool floor, it easily picks up dirt and debris. It is not necessary for each wheel or roller (250) to include an intake port (230). For example, as shown in FIG. 5 only the front wheels or rollers include intake ports (230). The number of water intake ports (230) depends on the application or the required cleaning power. The intake ports of the above described embodiments are all located on the vehicle close to pool floor. Actually water intake port can be placed on body shell but not close to swimming pool floor.

Figure 6:
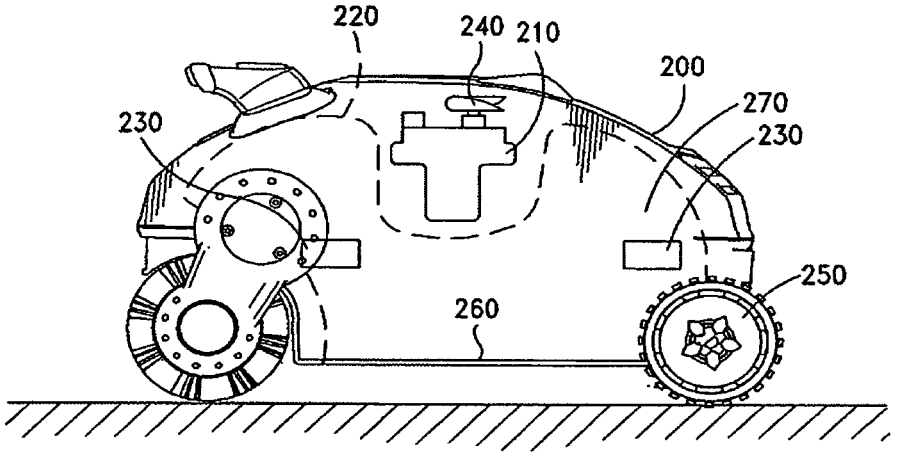
FIG. 6 illustrates another exemplary embodiment of the pool cleaning device in accordance with this invention.

FIG. 6 illustrates another a pool cleaning device embodiment. In this embodiment, the intake ports (230) the external wall (270) but not close to swimming pool floor. Here, the intake ports are above the wheels and/or rollers (250). The intake ports (230) have an opening facing toward the wheels and/or rollers (250). As illustrated, the intake ports (230) in this embodiment are neither horizontal nor vertical. The wheels and/or rollers stir up dirt and debris or segregates from the pool floor as the vehicle moves along, the water intake ports (230) have an opening facing toward the wheel/roller for easily picking up the dirt and debris even when the intake ports aren't necessarily close to the swimming pool floor.

Figure 7:
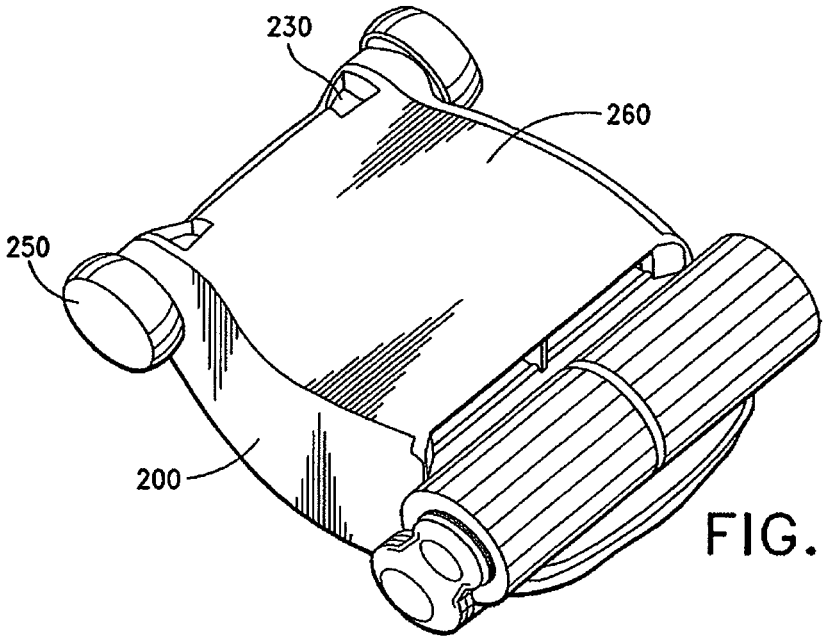
FIG. 7 illustrates another exemplary embodiment of the pool cleaning device in accordance with this invention.

FIG. 7 illustrates another embodiment of the swimming pool cleaning device in accordance with this invention. In this embodiment, Here, the vehicle includes a concave bottom (260), which is curved inwards toward the interior. The concaved bottom (260) discourages the vehicle from becoming stuck or hung up on obstacles as it moves along the floor of the swimming pool. When the vehicle encounters obstacles on the floor such as step or drain cover as a result of the concave bottom, it easily runs over the obstacle. In this embodiment, there is an intake port (230) proximate to each wheel/roller (250).

Figure 8:
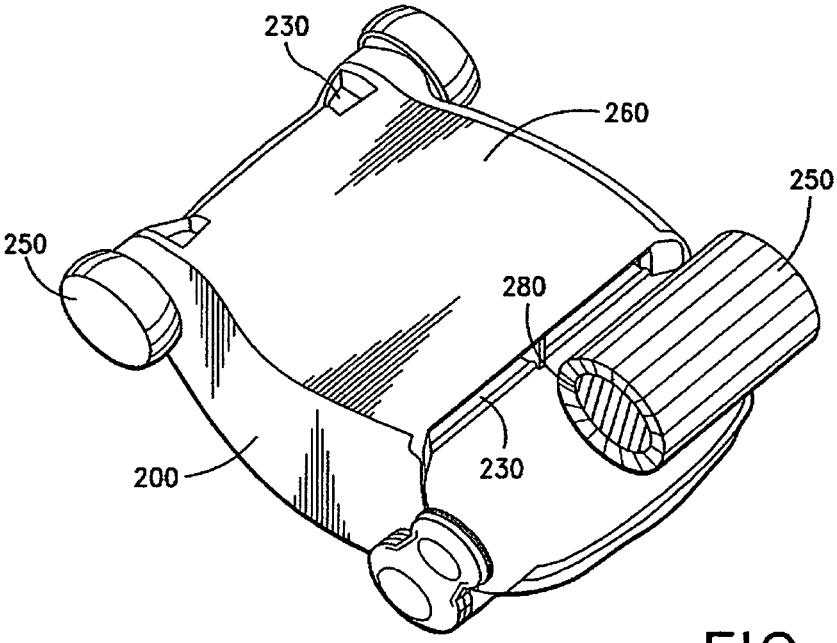
FIG. 8 illustrates another exemplary embodiment of the pool cleaning device in accordance with this invention.

FIG. 8 illustrates another embodiment of the swimming pool cleaning device in accordance with this invention. In this embodiment, The bottom (260) is also concave and curves inwardly toward the interior. The vehicle includes 2 rollers (250) on either end of the vehicle. The intake ports (230) are located on the body shell (200). Here, the intake ports (230) are located on the guard wall (280) and around the roller (250). More specifically, the intake ports form part of the guard wall (280). The intake ports have and opening facing the roller (250). It will be appreciated that the intake port opening of this embodiment, is neither horizontal nor vertical. It is within the spirit and scope of this invention that the roller (250) is replaced by a wheel (250) and that intake ports (230) are located on the guard wall (280) proximate to the wheel (250)

While the foregoing detailed description has described several embodiments of the cleaning vehicle in accordance with this invention, it is to be understood that the above description is illustrative only and not limiting of the disclosed invention. It will be appreciated there are also various modifications of the intake ports and their location on the cleaning vehicle are suitable for use in the exemplary embodiments discussed above and that there are numerous embodiments that are not mentioned but within the scope and spirit of this invention. Thus, the invention is to be limited only by the claims as set forth below.

What is claimed is:

1. A swimming pool cleaning device comprising:

a vehicle having a bottom;

a body shell defining an interior;

multiple water intake ports, said multiple water intake ports being located on at least side walls of the body shell;

at least one water outlet port, located on the body shell;

a drive mechanism proximate to the vehicle bottom with the intake port being in close proximity to the drive mechanism.

2. The swimming pool cleaning device as set forth in claim 1, wherein a single or multiple water intake port has an opening facing the drive mechanism.

3. The swimming pool cleaning device as set forth in claim 1, wherein at least one of the multiple water intake port has an opening facing a swimming pool floor, when the vehicle moves along the pool floor.

4. The swimming pool cleaning device as set forth in claim 1, wherein the vehicle includes a filter bag in the interior and the multiple water intake ports communicate with the filter bag.

5. The swimming pool cleaning device as set forth in claim 4, wherein at least one of the multiple water intake ports is located on the bottom of the vehicle.

6. The swimming pool cleaning device as set forth in claim 5, wherein at least one of the multiple water intake ports is in close proximity to one end of the vehicle.

7. The swimming pool cleaning device as set forth in claim 1, wherein the bottom defines a concave surface concaved inwardly toward the interior.

8. The swimming pool cleaning device as set forth in claim 4, wherein at least one of the multiple water intake ports is located on an outside of the body shell and close to the bottom of the vehicle.

9. The swimming pool cleaning device as set forth in claim 1,2,3, or 4, wherein the drive mechanism includes a guard wall and wherein at least one of the multiple water intake ports is located on the guard wall.

10. The swimming pool cleaning device as set forth in claim 9, wherein at least one of the multiple water intake ports forms part of the guard wall.

11. A swimming pool cleaning device comprising:

a vehicle having a bottom and a housing defining a body shell, the shell having an interior and the bottom being concaved and concaving towards the interior;

multiple intake ports, with at least one intake port being located at ends of the vehicle;

at least one outlet port, located on the vehicle; and a drive mechanism proximate to the vehicle bottom.

12. The swimming pool cleaning device as set forth in claim 11, wherein the vehicle includes a single filter bag and wherein each intake port communicates with the filter bag.

13. The swimming pool cleaning device as set forth in claim 11, wherein there are multiple filter bags and each intake port communicates with a filter bag.

14. The swimming pool cleaning device as set forth in claim 11, wherein the vehicle includes a guard wall for the driver mechanism and wherein intake ports are located on the guard wall.

15. The swimming pool cleaning device as set forth in claim 11, wherein the vehicle includes a guard wall for the driver mechanism and wherein intake ports form part of the guard wall.

* * * * *